United States Patent [19]

Richeson Jr. et al.

[11] Patent Number: 4,899,700

[45] Date of Patent: Feb. 13, 1990

[54] PNEUMATICALLY POWERED VALVE ACTUATOR

[75] Inventors: William E. Richeson Jr.; Federick L. Erickson, both of Fort Wayne, Ind.

[73] Assignee: Magnavox Government and Electronic Company, Fort Wayne, Ind.

[21] Appl. No.: 153,155

[22] Filed: Feb. 8, 1988

[51] Int. Cl.[4] ..... F01L 9/00; F01L 9/04

[52] U.S. Cl. ..... 123/90.11; 123/90.14; 137/625.64; 91/465

[58] Field of Search ..... 123/90.11, 90.14, 90.24; 137/625.64; 91/465

[56] References Cited

U.S. PATENT DOCUMENTS

| | | | |
|---|---|---|---|
| 2,552,960 | 5/1951 | Grieshaber et al. | 123/90.14 |
| 4,074,699 | 2/1978 | Stampfli | 137/625.64 |
| 4,257,573 | 3/1981 | Stampfli | 137/625.64 |
| 4,605,197 | 8/1986 | Casey et al. | 137/625.64 |

FOREIGN PATENT DOCUMENTS

| | | | |
|---|---|---|---|
| 197808 | 8/1978 | Fed. Rep. of Germany | 123/90.14 |

*Primary Examiner*—Charles J. Myhre
*Assistant Examiner*—Weilun Lo
*Attorney, Agent, or Firm*—Roger M. Rickert; Thomas A. Briody; Richard T. Seeger

[57] ABSTRACT

A bistable electronically controlled pneumatically powered transducer for use, for example, as a valve mechanism actuator in an internal combustion engine is disclosed. The transducer has an armature including a piston which is coupled to an engine valve, for example. The piston is powered by a pneumatic source and includes pneumatic and hydraulic damping as it nears its destination postion. The armature is held in each of its extreme positions by pneumatic pressure under the control of control valves which are in turn held in their closed postions by permanent magnet latching arrangements and are released therefrom to supply air to the piston to be pneumatically driven to the other extreme position by an electromagnetic arrangement which temporarily neutralizes the permanent magnetic field of the latching arrangement.

21 Claims, 9 Drawing Sheets

PNEUMATICALLY POWERED VALVE ACTUATOR

SUMMARY OF THE INVENTION

The present invention relates generally to a two position, straight line motion actuator and more particularly to a fast acting actuator which utilizes pneumatic energy against a piston to perform extremely fast transit times between the two positions. The invention utilizes a pair of control valves to gate high pressure air to the piston and latching magnets to hold the valves in their closed positions until a timed short term electrical energy pulse excites a coil around a magnet to partially neutralize the magnet's holding force and release the associated valve to move in response to high pressure air to an open position. Stored pneumatic gases accelerate the piston rapidly from one position to the other position. During movement of the piston from one position to the other, intermediate pressure air fills a chamber applying an opposing force on the piston to slow the piston.

This actuator finds particular utility in opening and closing the gas exchange, i.e., intake or exhaust, valves of an otherwise conventional internal combustion engine. Due to its fast acting trait, the valves may be moved between full open and full closed positions almost immediately rather than gradually as is characteristic of cam actuated valves.

The actuator mechanism may find numerous other applications such as in compressor valving and valving in other hydraulic or pneumatic devices, or as a fast acting control valve for fluidic actuators or mechanical actuators where fast controlled action is required such as moving items in a production line environment.

Internal combustion engine valves are almost universally of a poppet type which are spring loaded toward a valve-closed position and opened against that spring bias by a cam on a rotating cam shaft with the cam shaft being synchronized with the engine crankshaft to achieve opening and closing at fixed preferred times in the engine cycle. This fixed timing is a compromise between the timing best suited for high engine speed and the timing best suited to lower speeds or engine idling speed.

The prior art has recognized numerous advantages which might be achieved by replacing such cam actuated valve arrangements with other types of valve opening mechanism which could be controlled in their opening and closing as a function of engine speed as well as engine crankshaft angular position or other engine parameters.

In copending application Ser. No. 021,195 entitled ELECTROMAGNETIC VALVE ACTUATOR, filed Mar. 3, 1987 in the name of William E. Richeson and assigned to the assignee of the present application, there is disclosed a valve actuator which has permanent magnet latching at the open and closed positions. Electromagnetic repulsion may be employed to cause the valve to move from one position to the other. Several damping and energy recovery schemes are also included.

In copending application Ser. No. 07/153,257, entitled PNEUMATIC ELECTRONIC VALVE ACTUATOR, filed Feb. 8, 1988 in the names of William E. Richeson and Frederick L. Erickson there is disclosed a somewhat similar valve actuating device which employs a release type mechanism rather than a repulsion scheme as in the previously identified copending application. The disclosed device in this application is a truly pneumatically powered valve with high pressure air supply and control valving to use the air for both damping and as the primary motive force. This copending application also discloses different operating modes including delayed intake valve closure and a six stroke cycle mode of operation.

Other related applications all assigned to the assignee of the present invention and filed in the name of William E. Richeson on even date herewith are Ser. No. 07/153,262 POTENTIAL-MAGNETIC ENERGY DRIVEN VALVE MECHANISM where energy is stored from one valve motion to power the next, and Ser. No. 07/153,154 REPULSION ACTUATED POTENTIAL ENERGY DRIVEN VALVE MECHANISM wherein a spring (or pneumatic equivalent) functions both as a damping device and as an energy storage device ready to supply part of the accelerating force to aid the next transition from one i5 position to the other. One distinguishing feature of the REPULSION ACTUATED POTENTIAL ENERGY DRIVEN VALVE MECHANISM application is the fact that initial accelerating force is partly due to electromagnetic repulsion somewhat like that employed in the first abovementioned copending application.

In the first two mentioned copending applications, numerous advantages and operating mode variations suitable for incorporation with the present valve actuator are disclosed and the entire disclosures of all four of these applications are specifically incorporated herein by reference.

In the present invention, the power or working piston which moves the engine valve between open and closed positions is separated from the latching components and certain control valving structures so that the mass to be moved is materially reduced allowing much faster operation than in the above two identified applications. Latching and release forces are also reduced. Those valving components which have been separated from the main piston need not travel the full length of the piston stroke, thus, less power is consumed in moving components.

Among the several objects of the present invention may be noted the provision of a bistable fluid powered actuating device characterized by extremely fast transition times; the provision of a pneumatically driven actuating device which is tolerant of variations in air pressure and other operating parameters; the provision of an improved electronically controlled pneumatically powered valve actuating device; and the provision of a pneumatically powered valve actuator where the control valves within the actuator cooperate with, but operate separately from the main working piston. These as well as other objects and advantageous features of the present invention will be in part apparent and in part pointed out hereinafter.

In general, a bistable electronically controlled fluid powered transducer has an armature including an air powered piston which is reciprocable along an axis between first and second positions along with a control valve reciprocable along the same axis between open and closed positions. A magnetic latching arrangement functions to hold the control valve in the closed position while an electromagnetic arrangement may be energized to temporarily neutralize the effect of the permanent magnet latching arrangement to release the control valve to move from the closed position to the open position. Energization of the electromagnetic arrangement causes movement of the valve in one direction along the axis allowing fluid from a high pressure source to drive the armature in the opposite direction from the first position to the second position along the axis. The distance between the first and second positions of the armature is typically greater than the distance between the open and closed positions of the valve.

Also in general and in one form of the invention, a pneumatically powered valve actuator includes a valve actuator housing with a piston reciprocable inside the housing along an axis. The piston has a pair of oppositely facing primary working surfaces. A pair of air control valves are reciprocable along the same axis relative to both the housing and the piston between open and closed positions. A coil is electrically energized to selectively opening one of the air control valves to supply pressurized air to one of the primary working surfaces causing the piston to move. The piston cooperates with the just opened air control valve upon sufficient piston motion to modify the air pressure differential across that air control valve causing the air control valve to reclose. Each of the air control valves includes an air pressure responsive surface which urges the control valve, when closed, toward its open position and there may be an air vent located about midway between the extreme positions of piston reciprocation for dumping expanded air from the one primary working surface and removing the accelerating force from the piston. The air vent also functions to introduce air at an intermediate pressure to be captured and compressed by the opposite primary working surface of the piston to slow piston motion as it nears one of the extreme positions and the air vent supplies intermediate pressure air to one primary working surface of the piston to temporarily hold the piston in one of its extreme positions pending the next opening of an air control valve. The air control valve is uniquely effective to vent air from the piston for but a short time interval after damping near the end of a piston stroke while supplying air to power the piston during a much longer time interval earlier in the stroke.

BRIEF DESCRIPTION OF THE DRAWING

Corresponding reference characters indicate corresponding parts throughout the several views of the drawing.

Figure 1:
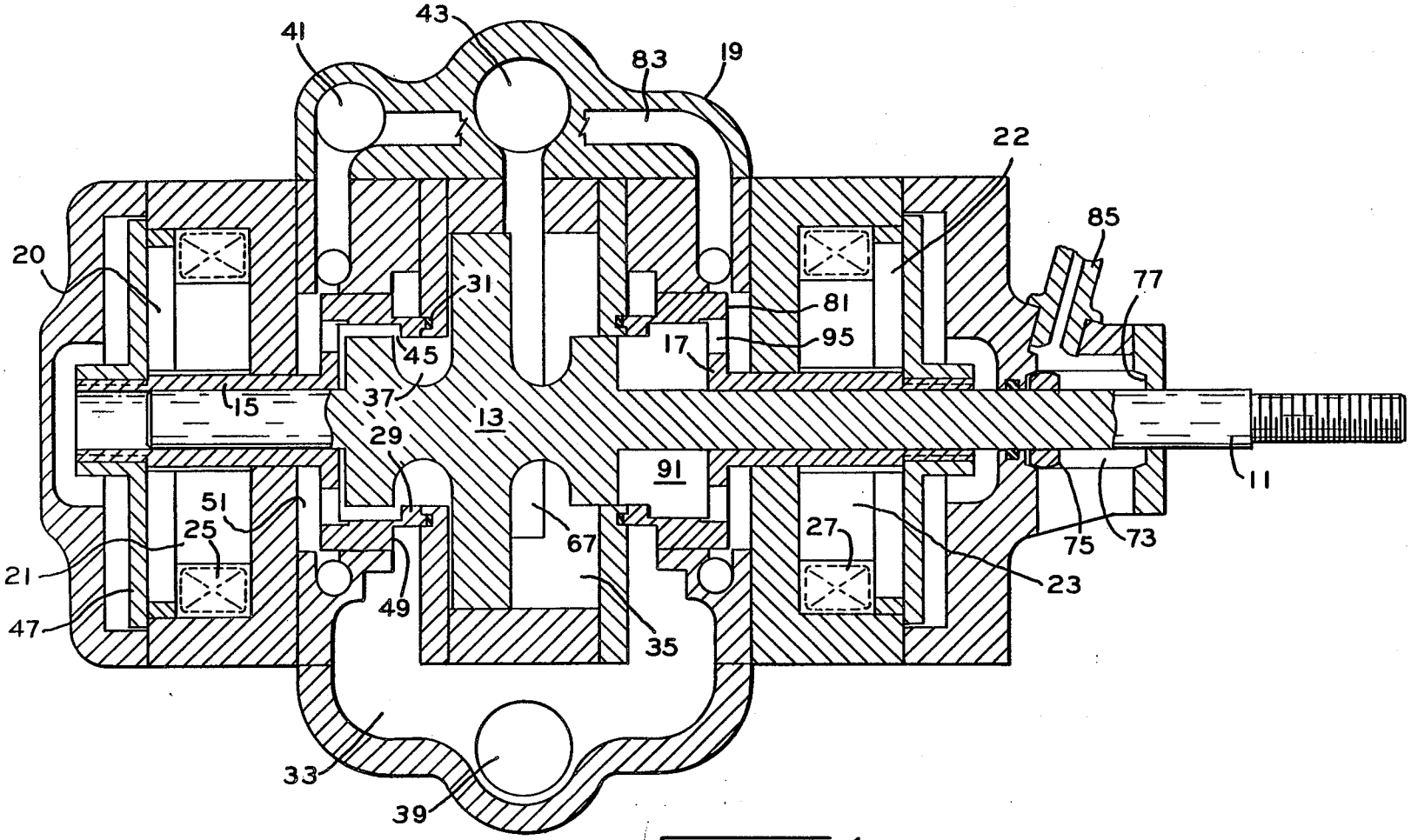
FIG. 1 is a view in cross-section showing the pneumatically powered actuator of the present invention with the power piston latched in its leftmost position as it would normally be when the corresponding engine valve is closed.

The exemplifications set out herein illustrate a preferred embodiment of the invention in one form thereof and such exemplifications are not to be construed as limiting the scope of the disclosure or the scope of the invention in any manner.

DESCRIPTION OF THE PREFERRED EMBODIMENT

The valve actuator is illustrated sequentially in FIGS. 1–8 to illustrate various component locations and functions in moving a poppet valve or other component (not shown) from a closed to an open position. Motion in the opposite direction will be clearly understood from the symmetry of the components. The actuator includes a shaft or stem 11 which may form a part of or connect to an internal combustion engine poppet valve. The actuator also includes a low mass reciprocable piston 13, and a pair of reciprocating or sliding control valve members 15 and 17 enclosed within a housing 19. The control valve members 15 and 17 are latched in one position by permanent magnets 21 and 23 and may be dislodged from their respective latched positions by energization of coils 25 and 27. The permanent magnet latching arrangement also includes iron pole pieces 20 and 22. The control valve members or shuttle valves 15 and 17 cooperate with both the piston 13 and the housing 19 to achieVe the various porting functions during operation. The housing 19 has a high pressure inlet port 39, a low pressure outlet port 41 and an intermediate pressure port 48. The low pressure may be about atmospheric pressure while the intermediate pressure is about 10 psi. above atmospheric pressure and the high pressure is on the order of 100 psi. gauge pressure.

FIG. 1 shows an initial state with piston 13 in the extreme leftward position and with the air control valve 15 latched closed. In this state, the annular abutment end surface 29 is inserted into an annular slot in the housing 19 and seals against an o-ring 31. This seals the pressure in cavity 33 and prevents the application of any moving force to the main piston 13. In this position, the main piston 13 being urged to the left (latched) by the pressure in cavity or chamber 35 which is greater than the pressure in chamber or cavity 37. In the position illustrated, annular opening 45 is in its final open position after having rapidly released compressed air from cavity 37 at the end of a previous leftward piston stroke. This rapid release is discussed in greater detail later in conjunction with FIGS. 9 and 10.

Figure 2:
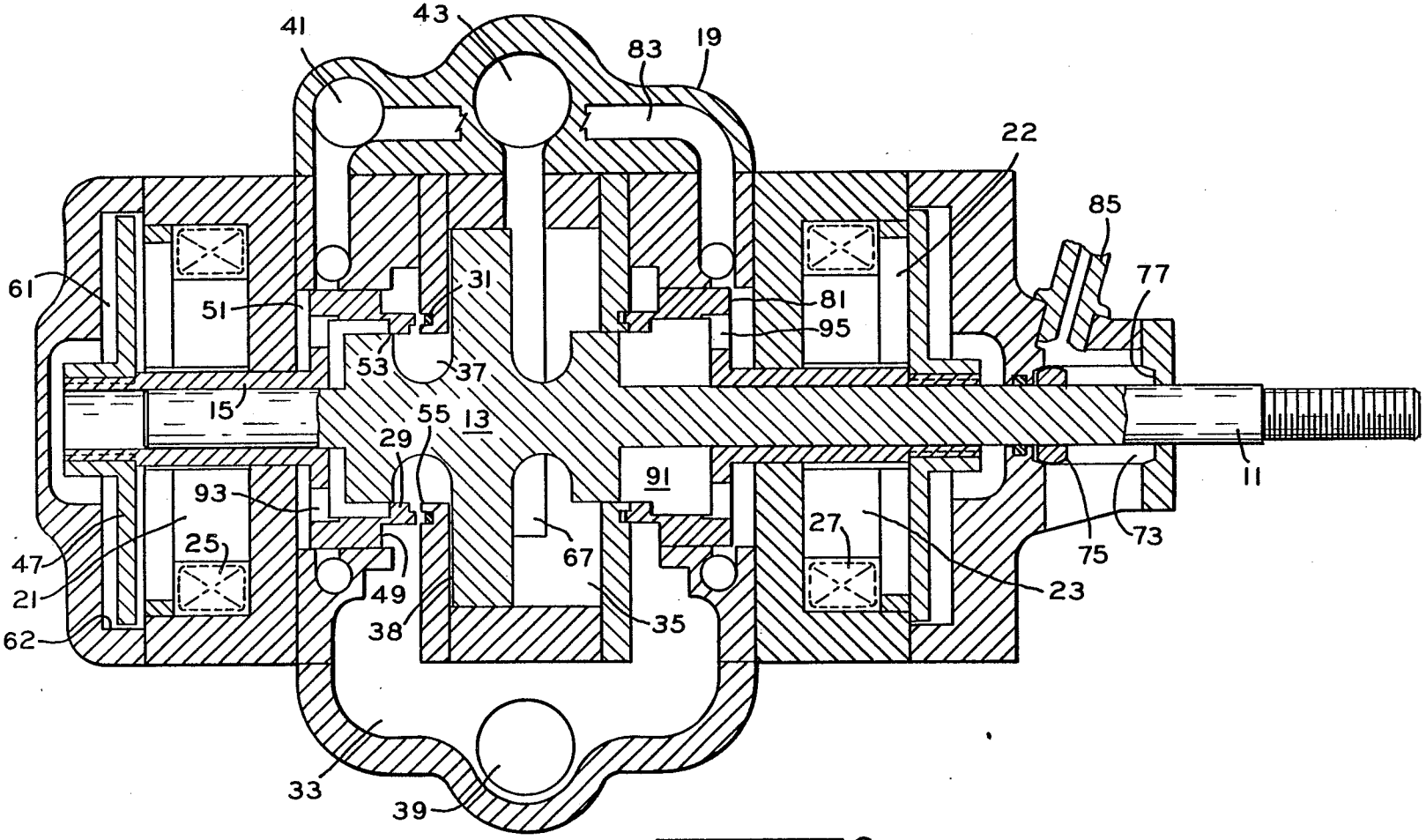
FIGS. 2–8 are views in cross-section similar to FIG. 1, but illustrating component motion and function as the piston progresses rightwardly to its extreme rightward or valve open position.

In FIG. 2, the shuttle valve 15 has moved toward the left, for example, 0.05 in. while piston 13 has moved toward the right perhaps half that distance and air at a high pressure now enters the annular cavity 37 from cavity 33 applying a motive force to the left face 38 of piston 13. The air valve 15 has opened because of an electrical pulse applied to coil 25 which has temporarily neutralized the holding force on iron armature or plate 47 by permanent magnet 21. When that holding force is temporarily neutralized, air pressure in cavity 33 which is applied to the air pressure responsive annular face 49 of valve 15 causes the valve to open. Notice that the communication between cavity 51 and the low pressure outlet port 41 has been interrupted by movement of the valve 15 before the valve clears the slot containing o-ring 31. This assures that no high pressure air escapes to the outlet port. It should also be noted that the edge of air valve 15 has overlapped the piston 13 at 53 closing annular opening 45 of FIG. 1 to assure rapid pressurization and maximum acceleration of the piston 13.

Figure 3:
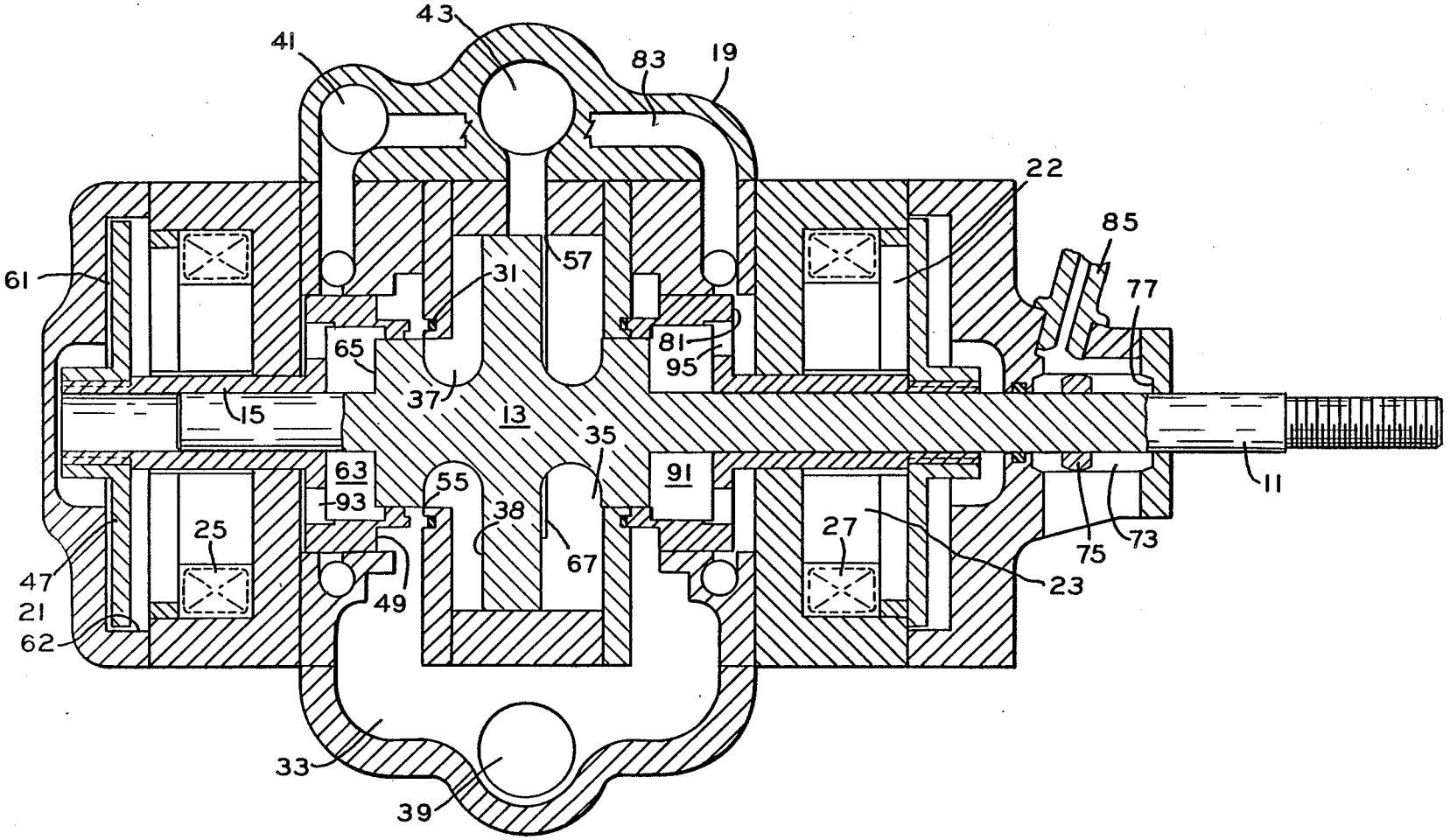

FIG. 3 shows the opening of the air valve 15 to about 0.10 in. ($\frac{2}{3}$ of its total travel) and movement of the piston 13 about 0.15 in. to the right. In FIG. 2, the high pressure air had been supplied to the cavity 37 and to the face 38 of piston 13 driving that piston toward the right.

That high pressure air supply to cavity 37 is now cut off by the edge of piston 13 passing the annular abutment 55 of the housing 19. Piston 13 continues to accelerate, however, due to the expansion energy of the high pressure air in cavity 37. The right edge of piston 13 is about to cut off communication at 57 between the port 43 and chamber 35. Disk 47 is nearing the leftward extreme of its travel and is compressing air in the gap 61. This offers a damping or slowing effort to reduce the end approach velocity and consequently reduce any impact of the air valve components with the stationary structure. The annular surface 62 which is shown as a portion of a right circular cylinder may be undercut (concave) or tapered (a conical surface) to restrict air flow more near one or both extremes of the travel of plate 47 to enhance damping without restricting motion intermediate the ends.

Figure 4:
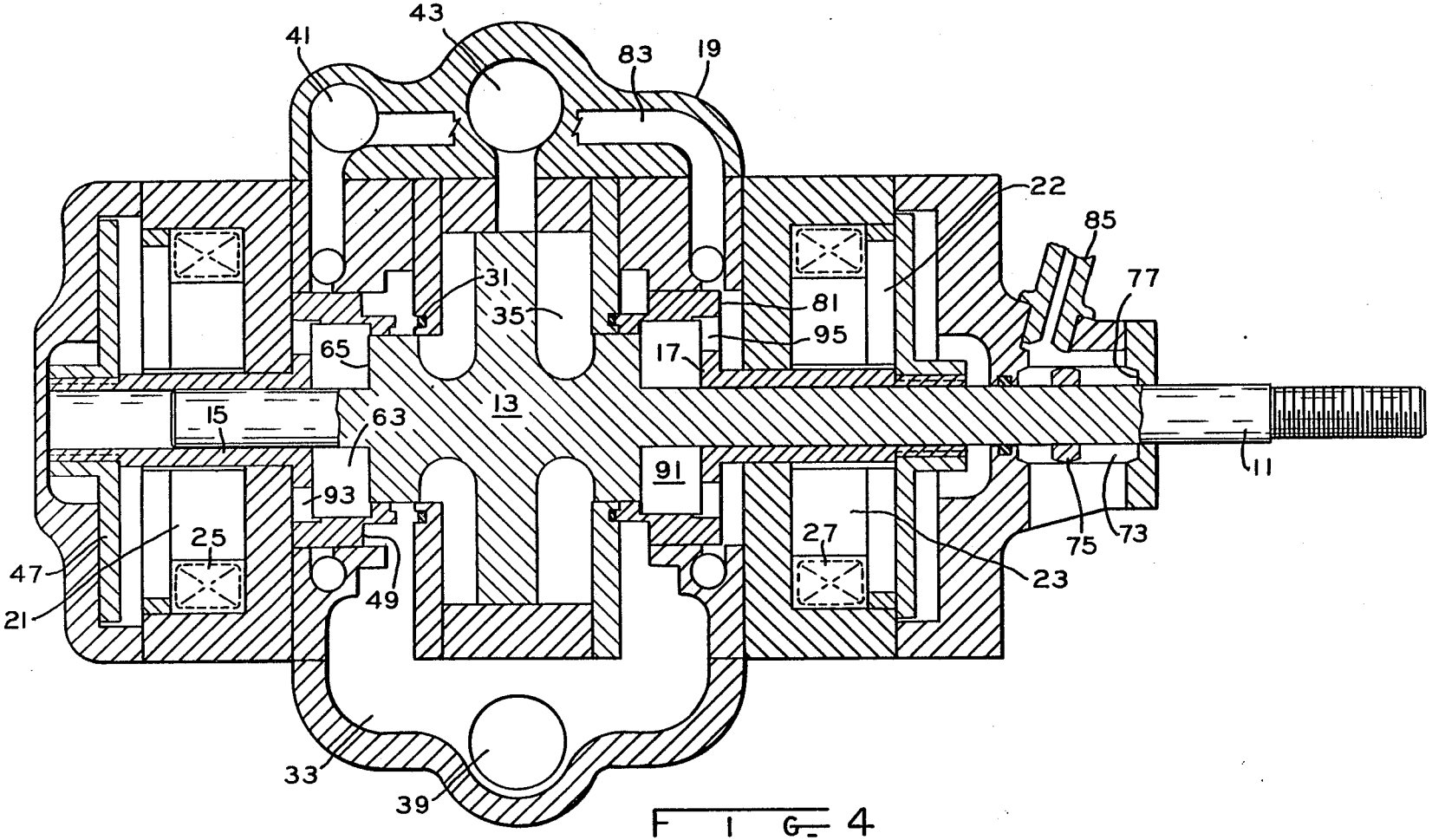

The piston 13 is continuing to accelerate toward the right in FIG. 4 and the air valve 15 has just reached its maximum leftward open displacement. The valve will tend to remain in this position for a short time due to the continuing air pressure on the annular surface 49 from high pressure source 39. There is a bleeding of air between the annular air valve and the piston into chamber 63 which is rapidly decreasing the pressure differential across the air valve 15 and this will soon allow the magnetic attraction of the disk 47 by the permanent magnet 21 to pull the air valve 15 back toward its closed position. This air bleeding is complete and the motion apparent in FIG. 6. A wave washer or other spring may be located between the disk 47 and the end of housing 19 to both add to the damping provided by the air trapped in the end chamber 61 (FIG. 3) and to give a more rapid return of the air valve to the closed position if desired. In FIG. 4, the main piston 13 has just closed off communication between chamber 35 and medium pressure port 43 and further rightward motion of the main piston will compress the air trapped in chamber 35 so that the piston will be slowed and stopped by the time it has reached its extreme right hand position.

Figure 5:
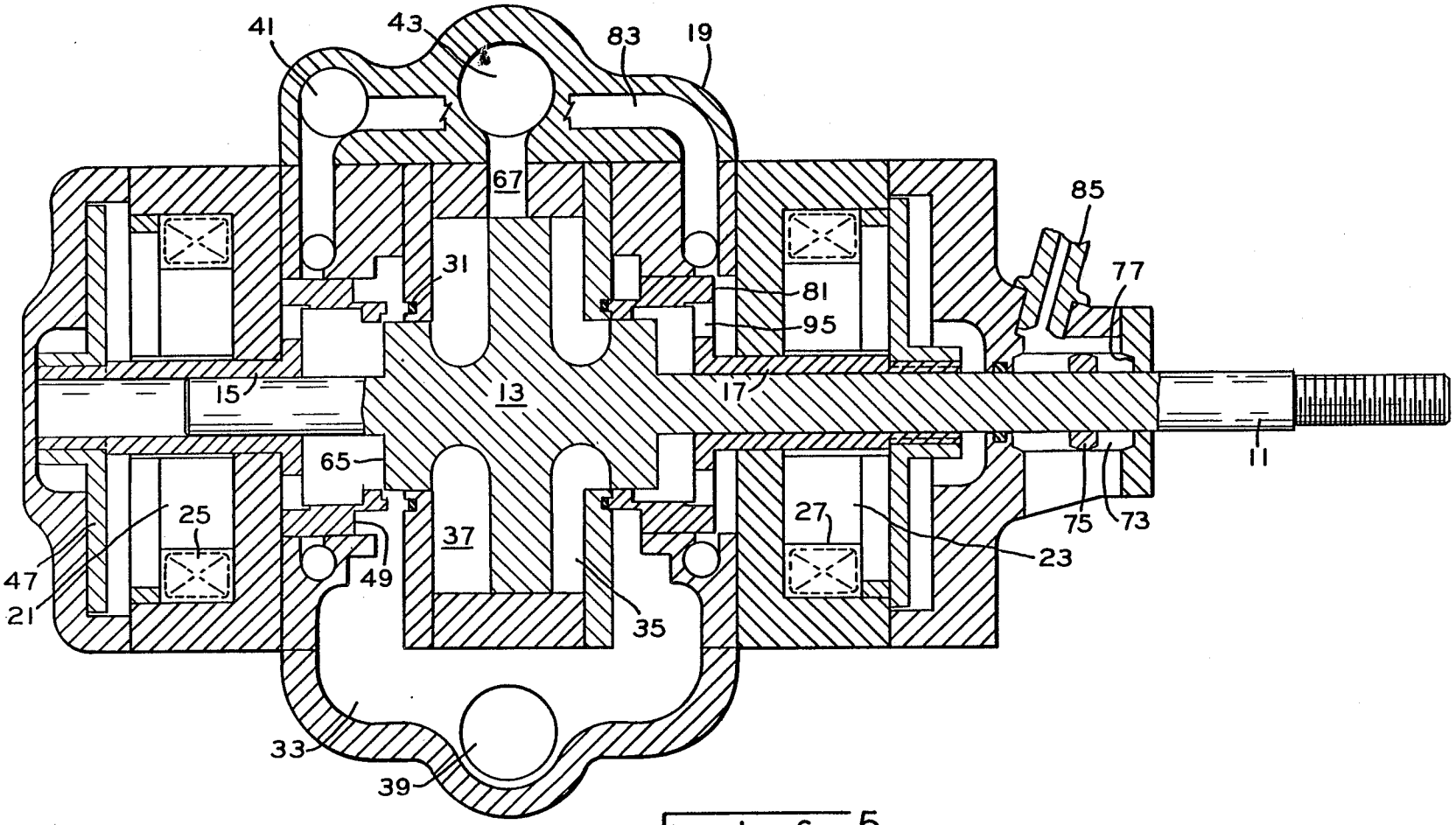
Figure 6:
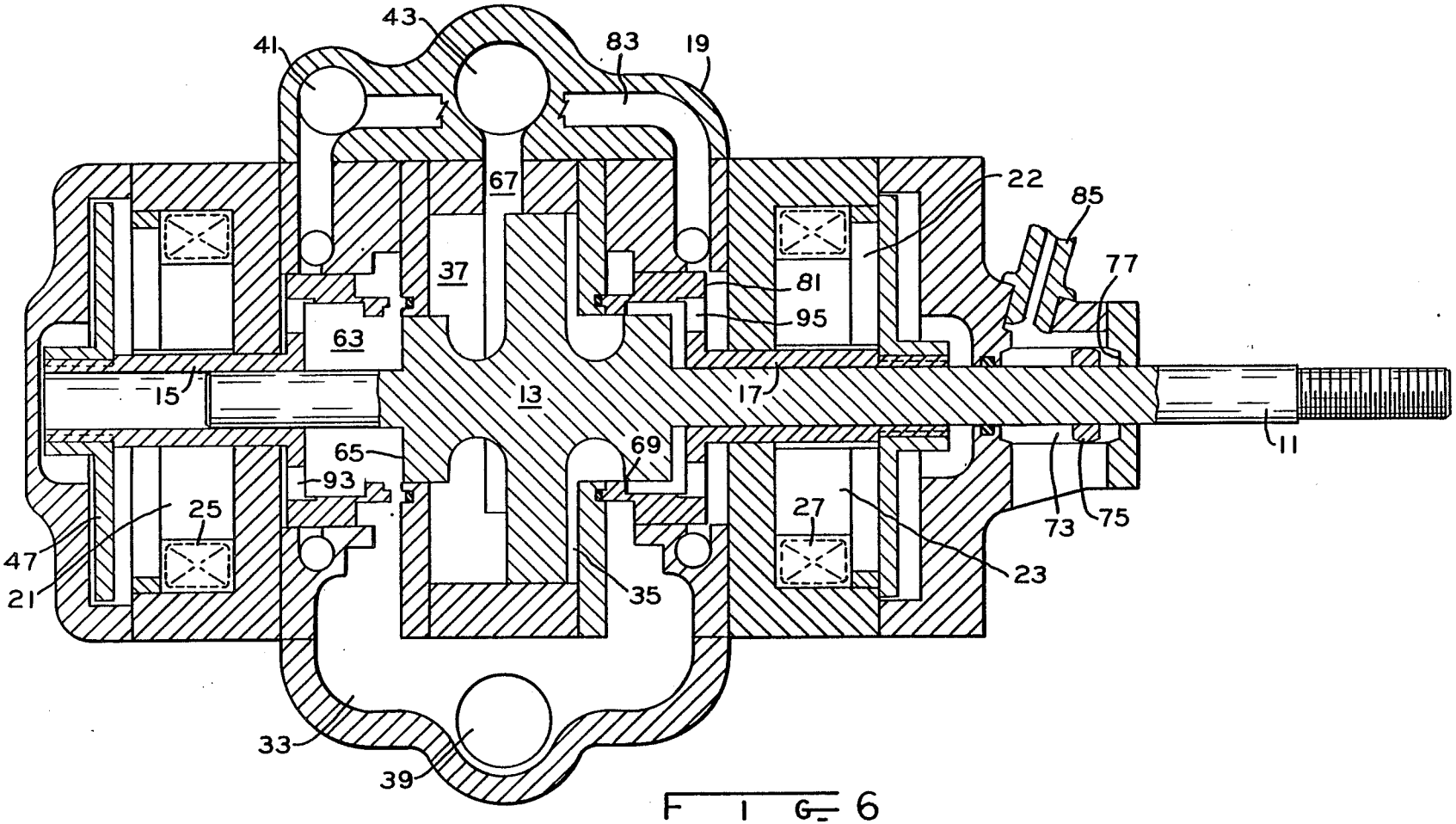

In FIG. 5, the air valve 15 is still in its extreme leftward position, but is just beginning to move toward the right to close the high pressure air port. For the first time, the main piston has cleared the edge of the valve 15 and high pressure air from source 39 is now applying a force against surface 65. This additional force on the piston 13 will continue so long as the valve remains open. The air valve is designed to close at about the same time as the main piston arrives at its furthest right hand location so the piston will experience this additional force during the remainder of its rightward movement. It has been found that this additional force on the piston helps to stabilize the damping of piston motion at the end of its travel and makes it much easier to adjust the intermediate pressure level at port 43 (and thus the initial pressure in cavity 35) to cancel any tendency for the main piston to bounce back prior to coming to rest at the right hand location. Also, in FIG. 5, the piston is continuing to compress the air in cavity 35 slowing its motion.

in FIG. 6, the air valve 15 is beginning to return to its closed position since all pressure around the valve has been neutralized and only the high attractive force of the magnet 21 on the disk 47 is causing the disk to move back toward the magnetic latch.

Further rightward movement of the piston as depicted in FIG. 6, uncovers the partial annular slot 67 leading to intermediate pressure port 43 so that the high pressure air in chamber 37 has blown down to the intermediate pressure. While the air valve has begun to close in FIG. 6, it is still open and the force of the high pressure air is still being applied to surface 65 helping to drive the piston toward the right and compress the air in chamber 35. In FIG. 6, the pressure in chamber 35 has reached a maximum and an annular opening is just beginning to form at 69 between the abutting corners of the piston 13 and air valve 17. This annular opening vents the high pressure air from chamber 35 just as the piston nears its right hand resting position to help prevent any rebound of the piston back toward the left.

It will be understood from the symmetry of the valve actuator that the behavior of the air control valves 15 and 17 in this venting or blow-down is, as are many of the other features, substantially the same near each of the opposite extremes of the piston travel. In each case, the air control valve, piston and a fixed portion of the housing cooperate to vent the damping air from the piston at the last possible moment while these same components cooperate at the beginning of a stroke to supply air to power the piston for a much longer portion of the stroke. Fragments of these components are shown in FIGS. 9 and 10 to better describe these two functions.

Figure 9:
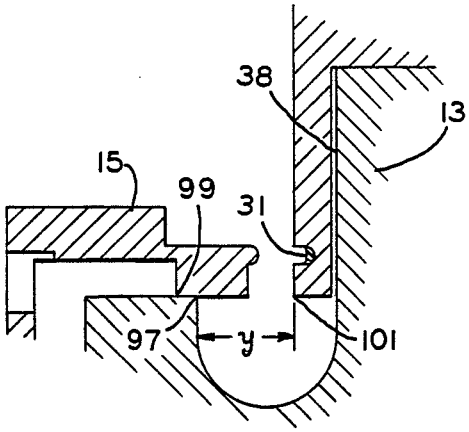
FIGS. 9 and 10 compare air control valve behavior during the power stroke and damping blow-down.
Figure 10:
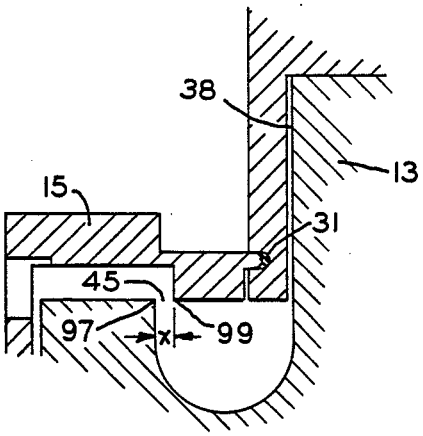

FIG. 9 illustrates the components in the same relative positions as in FIG. 2 while FIG. 10 depicts the components in the relative locations of FIG. 1. In FIG. 10, blow-down or dumping of damping air from the piston has taken place through annular opening 45 between the piston valve edge 97 and the extended porting edge 99. In FIG. 9, high pressure air is being supplied through the opening between the air valve 15 and the fixed porting edge 101 to the face 38 of piston 13 to drive the piston toward the right. It will be noted that the distance y in FIG. 9 which corresponds to the distance moved by the piston while air is being supplied to the face 38 is significantly greater than the distance x in FIG. 10 which is the piston travel during blow-down. This difference is achieved by moving or translating the effective porting edge back and forth during actuator operation.

The air valve 15 provides an extension at 99 of the fixed porting edge 101 when the air control valve is closed. This extension reduces the space (x in FIG. 10) between the piston valve edge 97 and the porting edge (now 99) so that the damping blow-down occurs during a very short time period from the narrow slot 45. However, when the air valve 15 is open, this extension is rendered inoperative allowing a larger closing distance (y in FIG. 9) between the piston valve edge 97 and the fixed porting edge 101 to assure a long power stroke. Thus, during leftward piston travel (FIG. 10), the distance (and therefore also the time) the piston travels while the port is open is considerably less than the length (and time) of piston travel toward the right while the port is open (FIG. 9).

Figure 7:
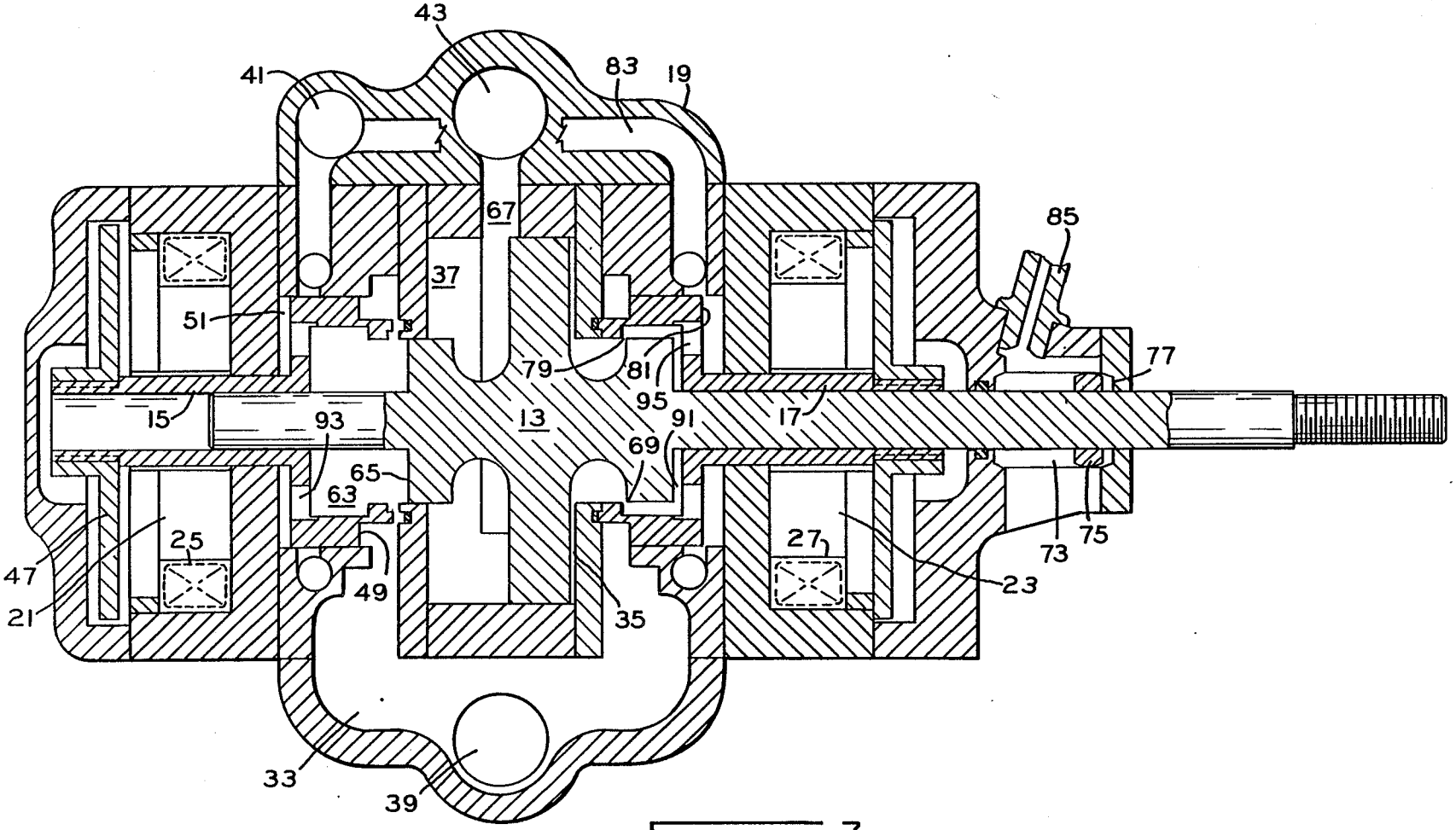

The damping of the piston motion near its right extremity is adjustable by controlling the intermediate pressure level at port 43 to effectively control the density of the air initially entrapped in chamber 35. If this intermediate pressure is too high, the piston will rebound due to the high pressure of the compressed air in chamber 35. If this pressure is too low, the piston will approach it end position too fast and may mechanically rebound due to metallic deflection or mechanical spring back. With the correct pressure, the piston will gently come to rest in its right hand position. A further final damping of piston motion may be provided during the last few thousandths of an inch of travel by a small hydraulic damper including a fluid medium filled cavity 73 and a small piston 75 fastened to and moving with the main piston 13. Near either end of the main piston travel, the small piston 75 enters a shallow annular restricted area 77 displacing the fluid therefrom and bringing the main piston to rest. Fluid, such as oil, may be supplied to the damping cavity 78 by way of inlet 85.

in FIG. 7, the air valve 15 is nearly completely closed to shut off the high pressure air supply to chamber 63. The high pressure air continues to exert a force on face 65 of piston 13 which will tend to stabilize the damping of piston motion which is occurring in chamber 35. The pressure in chamber 35 is being relieved through the annular opening 79 and through the opening 81 and channel 83 to the low pressure port 41 so that the pressure throughout chambers 35 and 86 is reduced to nearly atmospheric pressure. Note that valves 15 and 17 include a number of apertures such as 93 and 95 in their respective web portions allowing free air flow between chambers 81 and 91 or 51 and 63. The piston 13 is reaching a very low velocity, the damping is almost complete and the final damping by the small fluid piston 75 is underway.

Figure 8:
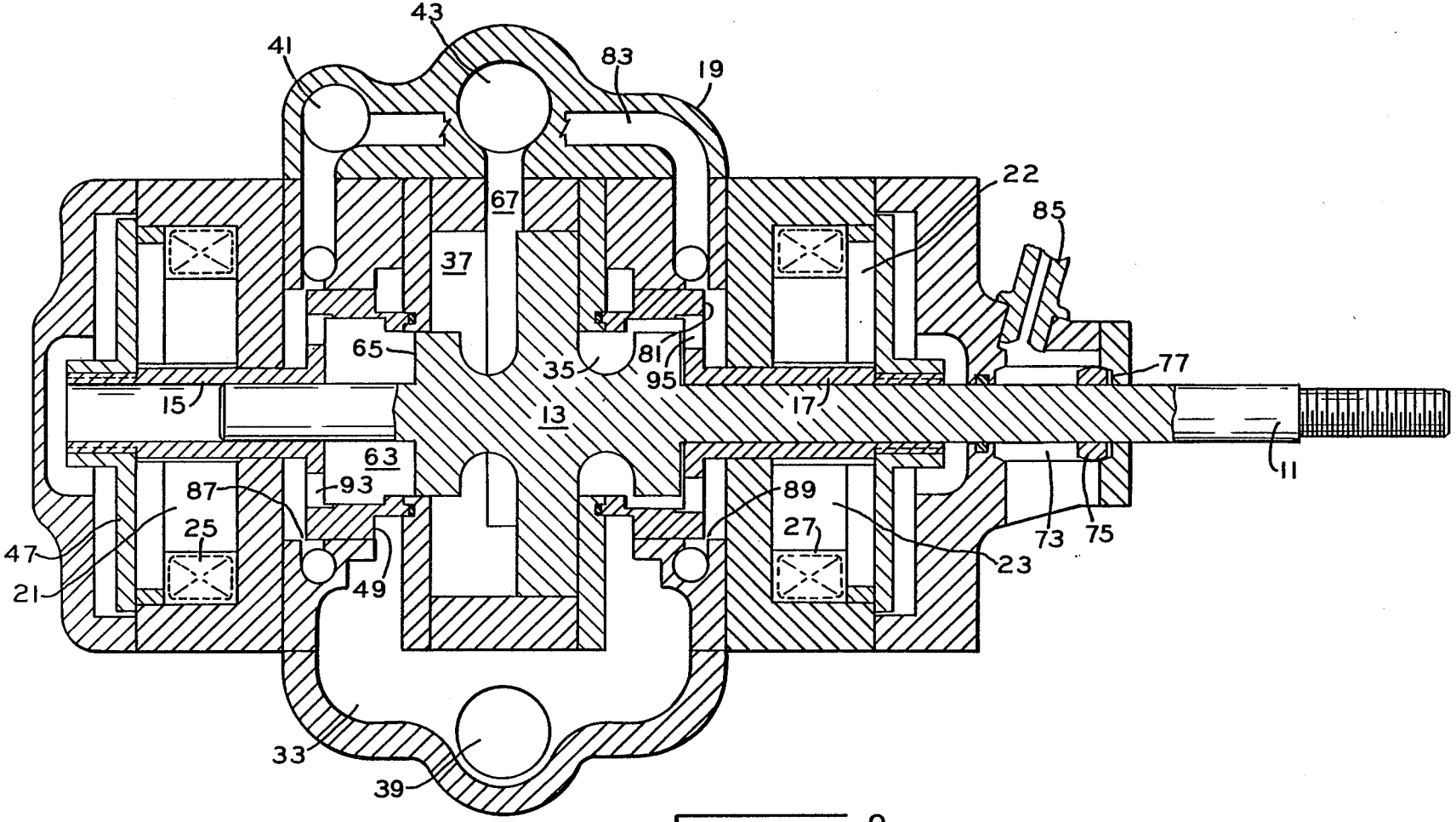

The main piston 13 has reached its righthand extreme in FIG. 8 and air valve 15 has closed off the supply of high pressure air from the source 39 to chamber 63. The respective annular openings 87 and 89 are venting chambers 63 and 35 to the low pressure port 41 and the piston is held or latched in the position shown by the intermediate pressure in chamber 37 from source 43.

In FIG. 1, which corresponds to a valve-closed condition, there is a slight gap between the piston face 38 and the valve housing while in FIG. 8 with the valve open, no such gap is seen. This gap provides for somewhat greater potential travel of the piston 13 than needed to close the engine valve insuring complete closure despite differential temperature expansions and similar problems which might otherwise result in the engine valve not completely closing.

Little has been said about the internal combustion engine environment in which this invention finds great utility. That environment may be much the same as disclosed in the abovementioned copending applications and the literature cited therein to which reference may be had for details of features such as electronic controls and air pressure sources. In this preferred environment, the mass of the actuating piston and its associated coupled engine valve is greatly reduced as compared to the prior devices. While the engine valve and piston move about 0.45 inches between fully open and fully closed positions, the control valves move only about 0.125 inches, therefore requiring less energy to operate. The air passageways in the present invention are generally large annular openings with little or no associated throttling losses.

From the foregoing, it is now apparent that a novel electronically controlled, pneumatically powered actuator has been disclosed meeting the objects and advantageous features set out hereinbefore as well as others, and that numerous modifications as to the precise shapes, configurations and details may be made by those having ordinary skill in the art without departing from the spirit of the invention or the scope thereof as set out by the claims which follow.

What is claimed is:

1. A bistable electronically controlled fluid-powered transducer having an armature reciprocable along an axis between first and second positions; a control valve reciprocable along said axis between open and closed positions; magnetic latching means for holding the control valve in the closed position; an electromagnetic arrangement for temporarily neutralizing the effect of the permanent magnet latching arrangement to release the control valve to move from the closed position to the open position; and a source of high pressure fluid; energization of the electromagnetic arrangement causing movement of the control valve in one direction along the axis allowing fluid to drive the armature in the opposite direction from the first position to the second position along the axis; a second control valve reciprocable along said axis between open and closed positions; second magnetic latching means for holding the second control valve in the closed position; a second electromagnetic arrangement for temporarily neutralizing the effect of the second permanent magnet latching arrangement to release the second control valve to move from the closed position to the open position; energization of the second electromagnetic arrangement causing movement of the second control valve in one direction along the axis allowing fluid to drive the armature in the opposite direction from the second position back to the first position along the axis.

2. The bistable transducer of claim 1 wherein the distance between the first and second positions is greater than the distance between the open and closed positions.

3. An electronically controllable pneumatically powered valve actuating mechanism for use in an internal combustion engine of the type having engine intake and exhaust valves with elongated valve stems, the actuator comprising:

a power piston reciprocable along an axis and adapted to be coupled to at least one of said intake and exhaust valves;

pneumatic motive means for moving the piston, thereby causing said at least one valve to move in the direction of stem elongation between valve-open and valve-closed positions, the pneumatic motive means including a pair of control valves movable relative to the piston for selectively supplying high pressure air to the piston; and pneumatic means for decelerating the piston as the valve nears one of said valve-open and valve-closed positions to slow valve motion as the at least one valve gets close to said one position.

4. The actuating mechanism of claim 3 wherein the pneumatic means cooperates with one of the control valves to disable the pneumatic means shortly prior to the time the control valve reaches said one position.

5. The actuating mechanism of claim 3 further comprising a pair of magnetic latches for holding corresponding control valves in closed positions.

6. An electronically controllable pneumatically powered bistable valve actuating mechanism for use in an internal combustion engine of the type having engine intake and exhaust valves with elongated valve stems, the actuator comprising:

a power piston reciprocable along an axis and adapted to be coupled to at least one of said intake and exhaust valves;

pneumatic motive means for causing the piston and said at least one valve to move in the direction of stem elongation between valve-open and valve-closed positions;

magnetic latching means including a control valve for rendering the pneumatic motive means ineffective; and means for releasing the magnetic latching means allowing the pneumatic motive means to move the at least one valve.

7. The electronically controllable pneumatically powered valve mechanism of claim 6 wherein the means for releasing comprises an electromagnetic arrangement for temporarily neutralizing the magnetic effect of the magnetic latching means to release the control valve to move from a closed position to an open position.

8. The electronically controllable pneumatically powered valve mechanism of claim 7 further comprising control circuitry for temporarily energizing the electromagnetic arrangement.

9. A bistable electronically controlled pneumatically powered transducer having an armature reciprocable between first and second positions, motive means including an air pressure source and an air control valve for causing the armature to move, a permanent magnet latching arrangement for holding the air control valve in a closed position, and an electromagnetic arrangement for temporarily neutralizing the effect of the permanent magnet latching arrangement to open the air control valve and cause the armature to move from one of said positions to the other of said positions.

10. The bistable electronically controlled pneumatically powered transducer of claim 9 further comprising control circuitry for temporarily energizing the electromagnetic arrangement.

11. A bistable electronically controlled pneumatically powered transducer having an armature including a piston reciprocable between first and second positions, motive means comprising a source of compressed air, an air vent located about midway between the first and second positions for dumping air and removing the accelerating force from the piston and for introducing air at an intermediate pressure to be captured and compressed by the piston to slow armature motion as the armature nears one of said positions.

12. The bistable electronically controlled pneumatically powered transducer of claim 11 further comprising a pair of air control valves and a pair of magnetic latching arrangements for holding the air control valves in closed positions.

13. The bistable electronically controlled pneumatically powered transducer of claim 12 further comprising a pair of electromagnetic devices for temporarily neutralizing the magnetic field of a corresponding magnetic latching arrangement to open the associated air control valve.

14. The bistable electronically controlled pneumatically powered transducer of claim 11 wherein the air vent supplies intermediate pressure air to one surface of the piston to temporarily hold the piston in one of the first and second positions.

15. A pneumatically powered valve actuator comprising a valve actuator housing; a piston reciprocable within the housing along an axis, the piston having a pair of oppositely facing primary working surfaces; a pair of air control valves reciprocable along said axis relative to both the housing and the piston between open and closed positions; and electrically energized means for selectively opening one of said air control valves to supply pressurized air to one of said primary working surfaces causing the piston to move, the piston cooperating with said one air control valve upon sufficient piston motion to modify the air pressure differential across said one air control valve causing said one air control valve to reclose.

16. The pneumatically powered valve actuator of claim 15 wherein each of the air control valves includes an air pressure responsive surface urging the control valve, when closed, toward its open position.

17. The pneumatically powered valve actuator of claim 15 further comprising an air vent located about midway between the extreme positions of piston reciprocation for dumping air from said one primary working surface and removing the accelerating force from the piston, and for introducing air at an intermediate pressure to be captured and compressed by the opposite primary working surface of the piston to slow piston motion as it nears one of the extreme positions.

18. The pneumatically powered valve actuator of claim 17 wherein the air vent supplies intermediate pressure air to one primary working surface of the piston to temporarily hold the piston in one of its extreme positions.

19. A pneumatically powered valve actuator comprising a valve actuator housing; a piston reciprocable within the housing along an axis, the piston having a pair of oppositely facing primary working surfaces; a pair of air control valves reciprocable along said axis relative to both the housing and the piston between open and closed positions; means for selectively opening one of said air control valves to supply pressurized air to one of said primary working surfaces causing the piston to move; and pneumatic means for decelerating the piston near the extremities of its reciprocation.

20. The pneumatically powered valve actuator of claim 19 wherein the pneumatic means cooperates with the air control valves to disable the pneumatic means shortly prior to the time the valve reaches either extremity.

21. The pneumatically powered valve actuator of claim 20, wherein the distance traveled by the piston while pressurized air is supplied to a primary working surface is greater than the distance traveled by the piston while the pneumatic means is disabled.

* * * * *